US012540289B2

(12) United States Patent
Kurchan et al.

(10) Patent No.: US 12,540,289 B2
(45) Date of Patent: Feb. 3, 2026

(54) LUBRICANT COMPOSITION COMPRISING TRACTION COEFFICIENT ADDITIVE

(71) Applicant: CARGILL BIOINDUSTRIAL UK LIMITED, Weybridge (GB)

(72) Inventors: Alexei Nikolaevich Kurchan, Plainsboro, NJ (US); Jacob Alexander Wegbreit, Haddonfield, NJ (US)

(73) Assignee: CARGILL BIOINDUSTRIAL UK LIMITED, London (GB)

( * ) Notice: Subject to any disclaimer, the term of this patent is extended or adjusted under 35 U.S.C. 154(b) by 0 days.

(21) Appl. No.: 18/564,722

(22) PCT Filed: May 26, 2022

(86) PCT No.: PCT/US2022/031029
§ 371 (c)(1),
(2) Date: Nov. 28, 2023

(87) PCT Pub. No.: WO2022/251423
PCT Pub. Date: Dec. 1, 2022

(65) Prior Publication Data

US 2024/0376394 A1 Nov. 14, 2024

Related U.S. Application Data

(60) Provisional application No. 63/194,392, filed on May 28, 2021.

(51) Int. Cl.

| | |
|---|---|
| ***C10M 145/38*** | (2006.01) |
| ***C10M 169/04*** | (2006.01) |
| *C10N 40/04* | (2006.01) |

(52) U.S. Cl.
CPC ..... *C10M 145/38* (2013.01); *C10M 169/041* (2013.01); *C10M 2205/003* (2013.01); *C10M 2209/109* (2013.01); *C10N 2040/04* (2013.01)

(58) Field of Classification Search
CPC ..... C10M 145/38; C10M 169/041; C10M 2205/003; C10M 2209/109; C10N 2040/04
USPC ..... 508/484
See application file for complete search history.

(56) References Cited

U.S. PATENT DOCUMENTS

| | | | | |
|---|---|---|---|---|
| 2016/0264907 | A1* | 9/2016 | Chen | C10M 145/38 |
| 2018/0100120 | A1* | 4/2018 | Flores-Torres | C10M 171/02 |
| 2020/0277542 | A1 | 9/2020 | Salvi | |

FOREIGN PATENT DOCUMENTS

| | | | |
|---|---|---|---|
| EP | 2746372 | B1 | 9/2020 |
| WO | 2011116049 | A1 | 9/2011 |
| WO | 2015065801 | A1 | 5/2015 |

* cited by examiner

*Primary Examiner* — Prem C Singh
*Assistant Examiner* — Francis C Campanell

(57) ABSTRACT

A lubricant composition suitable for use in an electric vehicle comprising a traction coefficient additive is provided herewith. The lubricant composition provides utility as an electric vehicle gear oil, and in particular electric vehicle transmission fluids. The lubricant composition provides improved coefficient of traction properties when in use as compared to equivalent lubricant compositions devoid of the traction coefficient additive.

14 Claims, No Drawings

LUBRICANT COMPOSITION COMPRISING TRACTION COEFFICIENT ADDITIVE

CROSS-REFERENCE TO RELATED APPLICATIONS

This application is a national phase application of PCT Application No. PCT/US2022/031029, filed May 26, 2022, which claims the benefit of U.S. Provisional Application No. 63/194,392, filed May 28, 2021, each of which is incorporated by reference herein in its entirety.

FIELD OF INVENTION

The present invention relates to a lubricant composition suitable for use in an electric vehicle comprising a traction coefficient additive. The lubricant composition as described herein provides utility inter alia in electric vehicle gear oil, and in particular electric vehicle transmission fluids, and provides improved coefficient of traction properties when in use as compared to equivalent lubricant compositions devoid of the additive.

BACKGROUND

Electric vehicles are vehicles which are propelled using one or more electric motors. Electric vehicles may be fully electric (also known as pure-electric or all-electric vehicles) or hybrid in nature (in a hybrid electric vehicle propulsion may be achieved from an alternative means, such as hydrocarbon derived fuel some of the time). Electric vehicles also include range-extended electric vehicles where the vehicle is powered by an electric motor and a plug-in battery, but the vehicle also comprises an auxiliary combustion engine which is used only to supplement battery charging and not as a primary source of propulsion. The present invention is suitable for use in all of the mentioned types of electric vehicle.

Gear oils are a sub-class of lubricant, and typically comprise a lubricant base stock (or base oil) as their majority component. The choice of lubricant base stock utilized in a lubricant oil can have a major impact on properties such as oxidation and thermal stability, volatility, low temperature fluidity, solvency of additives, contaminants and degradation products, and traction. More especially, it is traditionally taught by industry that traction coefficient of a lubricant is an inherent property of the lubricants base stock fluid (i.e., based on chemical composition of the base oil) and that traction coefficient is not affected by additives. It is widely believed in industry that the viscosity of the base stock fluid determines a lubricants coefficient of traction in use.

The choice of lubricant base stock can have a major impact on properties such as oxidation and thermal stability, volatility, low temperature fluidity, solvency of additives, contaminants and degradation products, and traction. The American Petroleum Institute (API) currently defines five groups of lubricant base stocks (API Publication 1509).

Groups I, II and III are mineral oils which are classified by the amount of saturates and sulphur they contain and by their viscosity indices. Table 1 below illustrates these API classifications for Groups I, II and III.

TABLE 1

| Group | Saturates | Sulphur | Viscosity Index (VI) |
|---|---|---|---|
| I | <90% | >0.03% | 80-120 |
| II | At least 90% | Not more than 0.03% | 80-120 |
| III | At least 90% | Not more than 0.03% | At least 120 |

Group I base stocks are solvent refined mineral oils, which are the least expensive base stock to produce, and currently account for the majority of base stock sales. They provide satisfactory oxidation stability, volatility, low temperature performance and traction properties and have very good solvency for additives and contaminants. Group II base stocks are mostly hydroprocessed mineral oils, which typically provide improved volatility and oxidation stability as compared to Group I base stocks. The use of Group II stocks has grown to about 30% of the US market. Group III base stocks are severely hydroprocessed mineral oils or they can be produced via wax or paraffin isomerisation. They are known to have better oxidation stability and volatility than Group I and II base stocks but have a limited range of commercially available viscosities.

Group IV base stocks differ from Groups I to III in that they are synthetic base stocks e.g. polyalphaolefins (PAOs). PAOs have good oxidative stability, volatility and low pour points. Disadvantages include moderate solubility of polar additives, for example antiwear additives.

Group V base stocks are all base stocks that are not included in Groups I to IV. Examples include alkyl naphthalenes, alkyl aromatics, vegetable oils, esters (including polyol esters, diesters and monoesters), polycarbonates, silicone oils and polyalkylene glycols.

The rapid move towards electrification of passenger vehicles has surpassed the understanding and specifications of current gear oil specifications of original equipment manufacturers (OEM's) and regulators. Current generation hybrid and electric vehicles still use standard automatic transmission fluid (ATF) formulations which were not specifically designed for this application. Current gear oils are not fulfilling the dynamic requirements of OEM's, due to rapid advancements in electric vehicle technology, ATF base fluids, and ad-packs. Furthermore, because the electric motor in an EV is highly efficient, any losses due to the gear lubricant in the EVs powertrain system can be quite large. Reduction in energy losses will provide improvements in the battery life at the EV in use, meaning that the EV requires less frequent charging as battery range is increased.

As such, despite continuous development of lubricant technology for transmission and gearboxes in internal combustion, hybrid and electrical vehicles, there remains a need for lubricant oil formulations with improved energy efficiency over the lifetime of the lubricant oil. More especially there is a need for lubricant technology optimized and tailored to meet the requirements of electric vehicle gearboxes, which differ in their requirements to those of traditional combustion engines. As such, new lubricant compositions which offer high performance in electric engines (in particular, low traction) but are commercially viable for the electric vehicle passenger car market are still actively sought.

It is an object of the present invention to provide a lubricant composition, suitable for use in the gearbox of electric vehicles, which provides improved low traction, achieved by the inclusion of a traction coefficient additive and therefore energy losses are minimized. As well as providing low traction, the lubricant composition should have sufficient oxidative stability as well as having good low temperature properties and compatibility with materials such as elastomers and copper.

SUMMARY OF THE INVENTION

We have now surprisingly discovered a lubricant composition which overcomes or significantly reduces at least one of the aforementioned problems.

Accordingly, the present invention provides a lubricant composition, which comprises a base stock and at least 2 wt % of a traction coefficient additive compound of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$.

The present invention also provides a method of reducing traction coefficient in a gearbox of an electric vehicle which comprises using a lubricant composition in accordance with the first embodiment of the invention.

The traction coefficient additive described herein may advantageously improve the performance of a gearbox of an electric vehicle to which the lubricant composition is applied by reducing the traction coefficient of the base stock.

The traction coefficient additive described herein can be used as a traction coefficient reducing additive in lubricant compositions, and more especially in gear oils for gearboxes in electric vehicles.

The traction coefficient additive comprises a compound of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$.

The traction coefficient additive is at least notionally built up from the group $R^1$ that can be considered as the "core group" of the compound. This core group is the residue (after removal of m active hydrogen atoms) of a compound containing at least 2 active hydrogen atoms, preferably present in hydroxyl and/or amino groups, and more preferably present in hydroxyl groups only. Preferably the core group is the residue of a substituted hydrocarbyl group, particularly a $C_3$ to $C_{30}$ substituted hydrocarbyl compound.

Examples of $R^1$ core groups include the residues of the following compounds after removal of m active hydrogen atoms:

1 glycerol and the polyglycerols, especially diglycerol and triglycerol, the partial esters thereof, or any triglycerides containing multiple hydroxyl groups, for example castor oil;

2 tri- and higher polymethylol alkanes such as trimethylol ethane, trimethylol propane, pentaerythritol and dipentaerythritol, and the partial esters thereof;

3 sugars, particularly non-reducing sugars such as sorbitol, mannitol, and lactitol, etherified derivatives of sugars such as sorbitan (the cyclic dehydro-ethers of sorbitol), partial alkyl acetals of sugars such as methyl glucose and alkyl (poly-) saccharides, and other oligo-/poly-mers of sugars such as dextrins, partially esterified derivatives of sugars, such as fatty acid esters, for example of lauric, palmitic, oleic, stearic and behenic acid, esters of sorbitan, sorbitol, and sucrose, aminosaccharides such as N-alkylglucamines and their respective N-alkyl-N-alkenoyl glucamides;

4 polyhydroxy carboxylic acids especially citric and tartaric acids;

5 amines including di- and poly-functional amines, particularly alkylamines including alkyl diamines such as ethylene diamine (1,2-diaminoethane);

6 amino-alcohols, particularly the ethanolamines, 2-aminoethanol, di-ethanolamine and triethanolamine;

7 carboxylic acid amides such as urea, malonamide and succinamide; and 8 amido carboxylic acids such as succinamic acid.

Preferred $R^1$ core groups are residues of groups having at least three, more preferably in the range from 4 to 10, particularly 5 to 8, and especially 6 free hydroxyl and/or amino groups. The $R^1$ group preferably has a linear $C_4$ to $C_7$, more preferably $C_6$ chain. The hydroxyl or amino groups are preferably directly bonded to the chain carbon atoms. Hydroxyl groups are preferred.

$R^1$ is preferably the residue of an open chain tetratol, pentitol, hexitol or heptitol group or an anhydro, e.g., cycloether anhydro, derivative of such a group. In a particularly preferred embodiment, $R^1$ is the residue of, or a residue derived from, a sugar, more preferably a monosaccharide such as glucose, fructose or sorbitol, a disaccharide such as maltose, palitose, lactitol or lactose or a higher oligosaccharide. $R^1$ is preferably the residue of a monosaccharide, more preferably of glucose, fructose, or sorbitol, and particularly of sorbitol.

The open chain form of $R^1$ groups is preferred, however groups including internal cyclic ether functionality can be used and may be obtained inadvertently if the synthetic route exposes the group to relatively high temperatures or other conditions, which promote such cyclisation.

The index m is a measure of the functionality of the $R^1$ core group and the alkoxylation reactions will replace some, or all, of the active hydrogen atoms (dependent on the molar ratio of core group to alkoxylation group) in the molecule from which the core group is derived. Reaction at a particular site may be restricted or prevented by steric hindrance or suitable protection. The terminating hydroxyl groups of the polyalkylene oxide chains in the resulting compounds are then available for reaction with the above defined acyl compounds. The index m will preferably be at least 3, more preferably in the range from 4 to 10, particularly 5 to 8, and especially 5 to 6. Mixtures may be, and normally are, employed, and therefore m can be an average value and may be non-integral.

The alkylene oxide groups AO are typically groups of the formula: —($C_rH_{2r}O$)— where r is 2, 3 or 4, preferably 2 or 3, i.e., an ethyleneoxy (—$C_2H_4O$—) or propyleneoxy (—$C_3H_6O$—) group, and it may represent different groups along the alkylene oxide chain. Generally, it is desirable that the chain is a homopolymeric ethylene oxide chain. However, the chain may be a homopolymer chain of propylene glycol residues or a block or random copolymer chain containing both ethylene glycol and propylene glycol residues. Usually, where co-polymeric chains of ethylene and propylene oxide units are used the molar proportion of ethylene oxide units used will be at least 50% and more usually at least 70%.

The number of alkylene oxide residues in the (poly) alkylene oxide chains, i.e., the average value of the parameter n, will suitably be in the range from 1 to 50, preferably 2 to 30, more preferably 2 to 20, particularly 2 to 10, and especially 3 to 8.

The groups $R^2$ are the "terminating groups" of the (poly) alkylene oxide chains. The terminating groups are hydrogen or $R^3$, where each $R^3$ is independently a residue of a polyhydroxyalkyl or polyhydroxyalkenyl carboxylic acid, a residue of a hydroxyalkyl carboxylic acid or hydroxyalkenyl carboxylic acid and/or a residue of an oligomer of the hydroxyalkyl or hydroxyalkenyl carboxylic acid. Preferably each $R^3$ is independently a residue of a polyhydroxyalkyl carboxylic acid, a residue of a hydroxyalkyl carboxylic acid and/or a residue of an oligomer of the hydroxyalkyl carboxylic acid, more preferably a residue of a polyhydroxyalkyl carboxylic acid.

Suitably at least 1.0, preferably at least 1.5, more preferably at least 2.0, particularly at least 2.2, and especially at least 2.4 of the $R^2$ groups are $R^3$. In addition, suitably up to 6.0, preferably up to 4.0, more preferably up to 3.0, particularly up to 2.7, and especially up to 2.5 of the $R^2$ groups are $R^3$.

The hydroxylalkyl and hydroxyalkenyl carboxylic acids are of formula HO—X—COOH where X is a divalent saturated or unsaturated, preferably saturated, aliphatic radical containing at least 8 carbon atoms and no more than 20 carbon atoms, typically from 11 to 17 carbons and in which there are at least 4 carbon atoms directly between the hydroxyl and carboxylic acid groups. Desirably the hydroxyalkyl carboxylic acid is 12-hydroxystearic acid. In practice such hydroxyalkyl carboxylic acids are commercially available as mixtures of the hydroxyl acid and the corresponding unsubstituted fatty acid. For example, 12-hydroxystearic acid is typically manufactured by hydrogenation of castor oil fatty acids including the C18 unsaturated hydroxyl acid and the non-substituted fatty acids (oleic and linoleic acids) which on hydrogenation gives a mixture of 12-hydroxystearic and stearic acids. Commercially available 12-hydroxystearic acid typically contains about 5 to 8% of unsubstituted stearic acid.

The polyhydroxyalkyl or polyhydroxyalkenyl carboxylic acid may be manufactured by polymerizing the above hydroxyalkyl or hydroxyalkenyl carboxylic acid. The presence of the corresponding unsubstituted fatty acid acts as a terminating agent and therefore limits the chain length of the polymer. Desirably the number of hydroxyalkyl or hydroxyalkenyl units is on average from 2 to 12, preferably from 3 to 10, more preferably from 4 to 9, particularly from 5 to 8, and especially 6 to 7. The molecular weight of the polyacid is typically from 600 to 3,000, particularly from 900 to 2,700, more particularly from 1,500 to 2,400 and especially about 2,100.

The residual acid value for the polyhydroxyalkyl or polyhydroxyalkenyl carboxylic acid typically is less than 50 mgKOH/g and a preferable range is 30 to 35 mgKOH/g. Typically the hydroxyl value for the polyhydroxyalkyl or polyhydroxyalkenyl carboxylic acid is a maximum of 40 mgKOH/g and a preferable range is 20 to 30 mgKOH/g.

The oligomer of the hydroxyalkyl or hydroxyalkenyl carboxylic acid may differ from the polymer in that termination is not by the unsubstituted corresponding fatty acid. Desirably it is a dimer of the hydroxylalkyl or hydroxyalkenyl carboxylic acid.

In one preferred embodiment, on average suitably at least 1.0, preferably at least 1.5, more preferably at least 2.0, particularly at least 2.3, and especially at least 2.4 of the $R^2$ groups are $R^3$ groups which are polyhydroxyalkyl carboxylic acid residues. In addition, on average suitably up to 4.0, preferably up to 3.5, more preferably up to 3.0, particularly up to 2.7, and especially up to 2.5 of the $R^2$ groups are $R^3$ groups which are polyhydroxyalkyl carboxylic acid residues. These polyhydroxyalkyl carboxylic acid residues suitably contain on average from 3 to 10, preferably from 4 to 9, more preferably from 5 to 8, particularly from 6 to 7, and especially 7 hydroxyalkyl monomer units.

The polyhydroxyalkyl carboxylic acid residues are preferably terminated with an unsubstituted carboxylic acid, more preferably with stearic acid.

In another preferred embodiment, when the $R^3$ groups comprise hydroxyalkyl carboxylic acid residues, preferably polyhydroxyalkyl carboxylic acid residues, the total number of all of the hydroxyalkyl carboxylic acid residues present in the compound of Formula (I) defined herein is suitably on average in the range from 5 to 30, preferably 8 to 20, more preferably 10 to 17, particularly 12 to 15, and especially 13 to 14 hydroxyalkyl monomer units.

In a further preferred embodiment, on average suitably at least 2.0, preferably at least 2.5, more preferably at least 3.0, particularly at least 3.3, and especially at least 3.5 of the $R^2$ groups are H. In addition, on average suitably up to 5.0, preferably up to 4.5, more preferably up to 4.0, particularly up to 3.7, and especially up 3.6 of the $R^2$ groups are H.

When the core group is derived from, for example, pentaerythritol, alkoxylation of the core residue may be evenly distributed over the four available sites from which an active hydrogen can be removed and on esterification of the terminal hydroxyl functions the distribution of acyl groups will be close to the expected random distribution. However, when the core group is derived from compounds, such as sorbitol, where all of the active hydrogen atoms are not equivalent, alkoxylation may give unequal chain lengths for the polyalkyleneoxy chains.

The traction coefficient additive can be made by firstly alkoxylating $R^1$ core groups containing m active hydrogen atoms, by techniques well known in the art, for example by reacting with the required amounts of alkylene oxide, for example ethylene oxide and/or propylene oxide. The second stage of the process preferably comprises reacting the aforementioned alkoxylated species with a polyhydroxyalkyl (alkenyl) carboxylic acid and/or a hydroxyalkyl (alkenyl) carboxylic acid under standard catalysed esterification conditions at temperatures up to 250° C. Thus, the traction coefficient additive of Formula (I) can be produced by reacting the group $R^1$ with alkylene oxide and then esterifying the alkoxylated product of this reaction with a polyhydroxyalkyl (alkenyl) carboxylic acid, a hydroxyalkyl (alkenyl) carboxylic acid, or a mixture thereof.

In one preferred embodiment, the traction coefficient additive is prepared by reaction of the alkoxylated core group $R^1$ with a polyhydroxyalkyl carboxylic acid where the molar ratio of alkoxylated core group to polyacid preferably ranges from 1:1 to 1:4, more preferably from 1:2 to 1:2.8. Preferably the traction coefficient additive prepared by this route has a molecular weight (Mn) between 3,000 to 10,000, more preferably 4,000 to 7000, and particularly 5,000 to 6,000.

The lubricant composition of the present invention comprises a base stock. The lubricant composition may comprise at least 50 wt %, preferably at least 60 wt %, more preferably at least 70 wt %, even more preferably least 75 wt % of base stock based on the total weight of the composition. The lubricant composition may comprise up to 98 wt %, preferably up to 95 wt %, more preferably up to 90 wt % base stock based on the total weight of the composition.

The lubricant composition comprises at least 2 wt %, suitably at least 2.5 wt %, preferably at least 3 wt %, more preferably at least 5 wt %, even more preferably at least 7 wt % of the traction coefficient additive based on the total weight of the composition. The lubricant composition may comprise up to 20 wt %, preferably up to 15 wt %, and most preferably up to 10 wt % of the traction coefficient additive based on the total weight of the lubricant composition.

In one embodiment, the lubricant composition is non-aqueous. However, it will be appreciated that components of the lubricant composition may contain small amounts of residual water (moisture) which may therefore be present in the lubricant composition. The lubricant composition may comprise less than 5% water by weight based on the total weight of the composition. More preferably, the lubricant composition is substantially water free, i.e. contains less than 2%, less than 1%, or preferably less than 0.5% water by weight based on the total weight of the composition. Preferably the lubricant composition is substantially anhydrous.

The lubricant composition suitably provides a gearbox oil suitable for use in an electrical vehicle. To adapt the lubricant composition to its intended use, the lubricant composition may further comprise one or more of the following further additive types:

1. Dispersants: for example, alkenyl succinimides, alkenyl succinate esters, alkenyl succinimides modified with other organic compounds, alkenyl succinimides modified by post-treatment with ethylene carbonate or boric acid, pentaerythritols, phenate-salicylates and their post-treated analogues, alkali metal or mixed alkali metal, alkaline earth metal borates, dispersions of hydrated alkali metal borates, dispersions of alkaline-earth metal borates, polyamide ashless dispersants and the like or mixtures of such dispersants.
2. Antioxidants: Antioxidants reduce the tendency of mineral oils to deteriorate in service which deterioration is evidenced by the products of oxidation such as sludge and varnish-like deposits on the metal surfaces and by an increase in viscosity. Examples of antioxidants include phenol type (phenolic) oxidation inhibitors, such as 4,4'-methylene-bis(2,6-di-tert-butylphenol), 4,4'-bis(2,6-di-tert-butylphenol), 4,4'-bis (2-methyl-6-tert-butylphenol), 2,2'-methylene-bis(4-methyl-6-tert-butyl-phenol), 4,4'-butylidene-bis(3-methyl-6-tert-butylphenol), 4,4'-isopropylidene-bis(2,6-di-tert-butylphenol), 2,2'-methylene-bis(4-me-thyl-6-nonylphenol), 2,2'-isobutylidene-bis(4,6-dimethylphenol), 2,2'-methylene-bis(4-methyl-6-cyclohexylphenol), 2,6-di-tert-butyl-4-methylphenol, 2,6-di-tert-butyl-4-ethyl phenol, 2,6-di-tert-butylphenol, 2,4-dimethyl-6-tert-butyl-phenol, 2,6-di-tert-l-dimethyl amino-p-cresol, 2,6-di-tert-4-(N,N'-dimethyl amino-methylphenol), 4,4'-thiobis(2-methyl-6-tert-butylphenol), 2,2'-thiobis(4-methyl-6-tert-butylphenol), bis(3-methyl-4-hydroxy-5-tert~butylbenzyl)-sulfide, and bis(3,5-di-tert-butyl-4-hydroxybenzyl). Other types of oxidation inhibitors include alkylated diphenylamines (e.g., Irganox L-57 ex. BASF, metal dithiocarbamate (e.g., zinc dithiocarbamate), and methylenebis(dibutyldithiocarbamate).
3. Anti-wear agents: As their name implies, these agents reduce wear of moving metallic parts. Examples of such agents include phosphates, phosphites, carbamates, esters, sulfur containing compounds, and molybdenum complexes.
4. Emulsifiers: for example, linear alcohol ethoxylates.
5. Demulsifiers: for example, addition products of alkylphenol and ethylene oxide, polyoxyethylene alkyl ethers, and polyoxyethylene sorbitan esters.
6. Extreme pressure agents (EP agents): for example, zinc dialkyldithiophosphate (primary alkyl, secondary alkyl, and aryl type), sulfurized oils, diphenyl sulfide, methyl trichlorostearate, chlorinated naphthalene, fluoroalkylpolysiloxane, and lead naphthenate. A preferred EP agent is zinc dialkyl dithiophosphate (ZnDTP), e.g. as one of the co-additive components for an anti-wear hydraulic fluid composition.
7. Multifunctional additives: for example, sulfurized oxymolybdenum dithiocarbamate, sulfurized oxymolybdenum organo phosphorodithioate, oxymolybdenum monoglycehde, oxymolybdenum diethylate amide, amine-molybdenum complex compound, and sulfur-containing molybdenum complex compound.
8. Viscosity index improvers: for example, polymethacrylate polymers, ethylene-propylene copolymers, styrene-isoprene copolymers, hydrogenated styrene-isoprene copolymers, polyisobutylene, and dispersant type viscosity index improvers.
9. Pour point depressants: for example, polymethacrylate polymers. Although it is a benefit of the present invention that pour point of the compound of formula (I) is suitable for use as a gearbox oil, embodiments utilising the relatively longer chain linear molecules may benefit from the addition of pour point depressant. Additionally, the presence of some alternative additives may adversely affect the formulation pour point making the addition of a pour point depressant attractive.
10. Foam inhibitors: for example, alkyl methacrylate polymers and dimethyl silicone polymers.
11. Friction modifiers: which may include amides, amines and partial fatty acid esters of polyhydric alcohols and include for example glycerol mono oleate, oleyl amide and alternative friction modifiers available from Croda under the "Perfad" tradename, or available from Nouryon under the "Ethomeen" tradename.

The lubricant composition may comprise at least 0.5 wt % of a further additive or a mixture of further additives, preferably at least 1 wt %, more preferably at least 5 wt % based on the total weight of the composition. The lubricant composition may comprise up to 30 wt % of a further additive or a mixture of further additives, preferably up to 20 wt %, more preferably up to 10 wt % based on the total weight of the composition.

The additive or additives may be available in the form of a commercially available additive pack. Such additive packs vary in composition depending on the required use of the additive pack. A skilled person may select a suitable commercially available additive pack for a gear oil. An example of a particularly suitable additive pack for the gear oil of the present invention is Evogen 5201 ex. Lubrizol, USA which is designed specifically for use in electric vehicles.

Notwithstanding the examples given above, to render the lubricant composition as a gear oil suitable for use in an electric vehicle, the selection of any additive(s) should take into account copper compatibility (because of the requirements of the electric motor), as well as provide or exhibit low (but not necessarily zero) electrical conductivity; not all additives commonly utilized for traditional combustion engine automotive engines will be suitable for use in electric vehicle power train fluids.

In this specification, base stock Group nomenclatures as defined by the American Petroleum Institute (API) will be used. The base stock may be selected based on the intended use of the lubricant composition.

Preferably the base stock is selected from the group consisting of an API Group I, II, III, IV, V base stock or mixtures thereof. More preferably the base stock is selected from an API Group II, III, IV, V, or mixture thereof. If the base stock includes a polyalphaolefin (PAO) from Group IV then the base stock may also desirably include a mineral oil from Group I, II or III or an ester from Group V to improve the solubility of the traction coefficient additive in the base stock. In the latter case, the ester from Group V may be present at between 5 wt % to 20 wt % of the lubricant composition to improve the solubility of the traction coefficient additive in the base stock. As such, the base stock may be a mixture of Group IV and Group V base stocks or Group IV and Group I, II or III base stocks.

The lubricant composition of the present invention is suitably used as a gearbox oil in an electrical vehicle. When the lubricant composition is a gearbox oil, the traction coefficient additive is preferably present at a concentration in the range from 2 to 10 wt % based on the total weight of the gearbox oil.

The lubricant composition may have a kinematic viscosity according to an ISO grade. An ISO grade specifies the mid-point kinematic viscosity of a sample at 40° C. in cSt ($mm^2/s$). For example, ISO 100 has a viscosity of 100±10 cSt and ISO 1000 has a viscosity of 1000±100 cSt. The lubricant composition preferably has a viscosity in the range from ISO 10 to ISO 680, more preferably ISO 15 to ISO 320.

The lubricant composition of the present invention allows for a reduction in the coefficient of traction relative to an equivalent lubricant composition devoid of the additive, over the temperature range 0 to 200° C., preferably over the temperature range of 20° C. to 100° C., more preferably over the range 40° C. to 60° C.

The lubricant composition of the present invention may be used in other technical areas where improvements in traction coefficient of a lubricant composition may be advantageous, that is the invention may have wider utility than just use in electric vehicles. As such, the gear oil described herein may be an industrial, automotive and/or marine gear oil. When the lubricant composition is a gear oil, the traction coefficient additive is preferably present in the range between 2 wt % to 10 wt % based on the total weight of the gear oil, so that improvements in relation to the lubricant base stock (or base oil) coefficient of traction are realised.

Industrial gear oils include those suitable for use in gear boxes with spur, helical, bevel, hypoid, planetary and worm gears. Suitable applications include use in mining; mills such as paper, textile, and sugar mills; steel production and in wind turbines. One preferred application is in wind turbines where the gear boxes typically have planetary gears. In a wind turbine, the gearbox is typically placed between the rotor of a wind turbine blade assembly and the rotor of a generator. The gearbox may connect a low-speed shaft turned by the wind turbine blade(s) rotor at about 10 to 30 rotations per minute (rpm), to one or more high speed shafts that drive the generator at about 1000 to 2000 rpm, the rotational speed required by most generators to produce electricity. The high torque exerted in the gearbox can generate huge stress on the gears and bearings in the wind turbine. A gear oil of the present invention may enhance the fatigue life of the gearbox of a wind turbine by reducing traction between the gears. Lubricants for use in wind turbines gearboxes are often subjected to prolonged periods of use between maintenance, i.e. long service intervals. Therefore, a long-lasting lubricant composition with high stability may be required, to provide suitable performance over lengthy durations of time; gear oils in accordance with the present invention may be suitable for such a use.

Traditional automotive gear oils (i.e. for combustion engines) include those suitable for use in manual transmissions, transfer cases and differentials which all typically use a hypoid gear. By transfer case we mean a part of a four-wheel drive system found in four-wheel drive and all-wheel drive systems. It is connected to the transmission and also to the front and rear axles by means of driveshafts. This is also referred to in the literature as a transfer gearcase, transfer gearbox, transfer box or jockey box. Although the present invention is particularly designed to be suitable for use in electrical vehicles (which have physical property requirements which differ to traditional automotive gear oils) the gear oils of the present invention may offer improvements in traction coefficient properties of base stocks for use in traditional automotive gear oils.

Marine thruster gearboxes have specific gear oils that include a higher proportion of additives, e.g. dispersants, anticorrosives, to deal with corrosion and water entrainment compared to industrial and automotive gear oils. There are also outboard gear oils used for the propeller unit which may be more relevant for smaller vessels.

The gear oils of the present invention may offer improvements in traction coefficient properties of base stocks for use in marine thruster gearboxes also.

The compounds of Formula (I) defined herein may be capable of reducing the traction coefficient lubricant composition, preferably a gear oil for an electric vehicle, when compared to an equivalent lubricant composition comprising no traction coefficient additive, by at least 5%, preferably by at least 10%, more preferably by at least 15%, particularly by at least 20%, and especially by at least 25% as measured using a mini-traction machine (MTM), in accordance with the test described herein, at a temperature of 40° C. and 60° C., load of 1.0 GPa and a Slide-to-Roll Ratio (SRR) of 30%. The coefficient of traction may be reduced, when compared to an equivalent lubricant composition comprising no traction coefficient additive and as described herein, over the temperature range 0 to 200° C., preferably over the range 20 to 100° C., more preferably over the range 40 to 60° C.

EXAMPLES

The invention will now be illustrated by the following non-limiting examples, wherein the following materials and test procedures are used:

Test Materials

PAO 4—Spectra Syn™ 4—an API Group IV synthetic poly alpha olefin base stock made by the reaction of linear alpha olefins available from ExxonMobil.

YUBASE 4—an API Group III VHVI base stock, available from SK Lubricants.

Priolube™ 3970—an API Group V synthetic ester base stock, available from Croda Inc.

EHC-45—API GRII base stock, available from ExxonMobil.

Perfad™ 3050—a commercially available polymeric friction modifier, available from Croda Inc.

Test Procedures

Mini-Traction Machine (MTM)

The MTM was supplied by PCS Instruments of London, UK. The MTM provide a method for measuring the coefficient of traction and friction of a given test sample using a ball-on-disc configuration whilst varying several properties such as speed, load and temperature. The MTM is a computer-controlled precision traction measurement system whose test specimens and configuration have been designed such that realistic pressures, temperatures and speeds can be attained without requiring large loads, motors or structures. Details of the test parameters employed in the data provided herein follow.

The disc was AISI 52100 hardened bearing steel with a mirror finish (Ra<0.01 mm) and the ball was AISI 52100 hardened bearing steel. The contact pressure was 0.43 GPa at rolling speed of 0.2 m/s, and 1 GPa at rolling speed of 0.1 m/s. Approximately 50 ml of the test sample was then added. The ball was loaded against the face of the disc and the ball and disc were driven independently to create a mixed rolling/sliding contact with a slide-roll ratio (SRR) of 30%. The frictional force between the ball and disc was measured by a force transducer. Additional sensors measured the applied load and test sample temperature.

The coefficient of traction of a lubricant control composition (i.e. a base stock with no traction reducing additive present) test sample was determined at 40° C. and 60° C. utilizing the MTM with a ¾ inch ball on a smooth disc (as defied above). The MTM tests were then repeated using test samples comprising the lubricant control composition with the addition of 2.5, 5, 7.5, or 10 wt % of the traction reducing additive being evaluated (either Sample 1 or Sample 2 as described below). Further tests were carried out utilizing test samples comprising the addition of a commercial lubricant additives. The test samples are more fully descried below.

Example 1 Preparation of Coefficient of Traction Additive (Sample 1)

Traction Additive Sample 1 was prepared in accordance with the following method: 12-hydroxystearic acid (68.7 wt %), PEG-12 sorbitol (31.3 wt %) and tin oxalate catalyst (Tegokat 160 ex Goldschmidt) were charged to a glass reactor and heated to 190° C. under nitrogen. The reaction was continued for 12-24 hours then cooled to below 100° C. and the product discharged. This provided a product (Sample 1) with a generalized composition as shown:

$$R^1[(AO)_n—R^2]_m$$

wherein:

$R^1$ is the residue of a sorbitol discharged.

m is 6;

AO is an ethylene oxide residue;

n average is 2;

each $R^2$ is independently H or $R^3$, where each $R^3$ is poly (12-hydroxystearic acid)

on average 0.58 of $R^2$ groups are $R^3$.

Example 2 Preparation of Coefficient of Traction Additive (Sample 2)

Traction Additive Sample 2 was prepared in accordance with the following method: 12-hydroxystearic acid (68.7 wt %), PEG-50 sorbitol (31.3 wt %) and tin oxalate catalyst (Tegokat 160 ex Goldschmidt) were charged to a glass reactor and heated to 190° C. under nitrogen. The reaction was continued for 12-24 hours then cooled to below 100° C. and the product discharged. This provided a product (Sample 2) with a generalized composition as shown:

$$R^1[(AO)_n—R^2]_m$$

wherein:

$R^1$ is the residue of a sorbitol m is 6;

AO is an ethylene oxide residue;

n average is 9;

each $R^2$ is independently H or $R^3$, where each $R^3$ is poly (12-hydroxystearic acid)

on average 0.58 of $R^2$ groups are $R^3$.

Example 3. MTM Test Data

The MTM data presented in the Tables 1, 2, 3, 4 and 5 below, show that both Sample 1 and Sample 2 (as described above) are effective at reducing the traction coefficient of the conventional lubricant base stocks; a reduction of the coefficient of traction as compared to the control sample of base stock alone is observed after introduction of the additive. MTM test data is provided for a selection of lubricant base stocks (i.e. control samples), selected to show the utility of the present additive technology across a range of API base stocks. The selection of base stocks for testing includes the following base stocks: Group III (YUBASE 4), and blends of conventional Group II, Group V (PAO 4) and ester (Priolube 3970).

The effectiveness of Sample 1 and Sample 2 as an additive for improving traction coefficient of a base stock is also compared to the effect on coefficient of traction of the base stock with inclusion of PAO 100. PAO 100 is a very commonly utilized thickener for traditional automotive gear oil formulations; it is known that the inclusion of PAO 100 increases the viscosity of a base stock, and the increase in viscosity can have a positive effect on coeffect of traction as a more viscous base stock is able to maintain a film at the test boundary.

From the data provided in the Tables below it can be seen that use of Samples 1 and 2 resulted in 2 to 10 times larger (in percent value) reduction of the traction coefficient of the base stock, especially for 2.5 wt % to 7.5 wt % treat rate range. For Samples 1 and 2 there appears to be an optimal treat rate between 5 wt % and 7.5 wt % inclusion based on the total weight of the composition, with further increase in concentration providing no benefit or even a detrimental increase in traction coefficient; this coefficient of traction improvement is distinct from the viscosity increase effect achieved by PAO 100 inclusion.

TABLE 1

MTM Traction coefficient data for a base stock comprising 80% PAO 4 and 20% Priolube 3970.

| | Additive treat rate (wt %) | | | | |
|---|---|---|---|---|---|
| | 0 | 2.5 | 5 | 7.5 | 10 |
| 40° C. 0.1M/S sliding speed | | | | | |
| Sample 1 | 0.042 | 0.0403 | 0.0348 | 0.0375 | 0.0358 |
| Sample 2 | 0.042 | 0.0392 | 0.0373 | 0.0374 | 0.0379 |
| PAO 100 | 0.042 | 0.0428 | 0.0399 | 0.0406 | 0.0388 |
| Traction coefficient, percent reduction compared to base stock | | | | | |
| Sample 1 | | 4 | 17 | 11 | 15 |
| Sample 2 | | 7 | 11 | 11 | 10 |
| PAO 100 | | −2 | 5 | 3 | 8 |
| 40° C. 0.2M/S sliding speed | | | | | |
| Sample 1 | 0.0249 | 0.0243 | 0.0225 | 0.0218 | 0.0227 |
| Sample 2 | 0.0249 | 0.0234 | 0.0216 | 0.0222 | 0.0221 |
| PAO 100 | 0.0249 | 0.0242 | 0.024 | 0.0242 | 0.0241 |
| Traction coefficient, percent reduction compared to base stock | | | | | |
| Sample 1 | | 2 | 10 | 12 | 9 |
| Sample 2 | | 6 | 13 | 11 | 11 |
| PAO 100 | | 3 | 4 | 3 | 3 |
| 60° C. 0.1M/S sliding speed | | | | | |
| Sample 1 | 0.0465 | 0.0421 | 0.0366 | 0.0397 | 0.0345 |
| Sample 2 | 0.0465 | 0.0382 | 0.0357 | 0.0368 | 0.0458 |
| PAO 100 | 0.0465 | 0.052 | 0.0443 | 0.0398 | 0.0404 |
| Traction coefficient, percent reduction compared to base stock | | | | | |
| Sample 1 | | 9 | 21 | 15 | 26 |
| Sample 2 | | 18 | 23 | 21 | 2 |
| PAO 100 | | −12 | 5 | 14 | 13 |
| 60° C. 0.2M/S sliding speed | | | | | |
| Sample 1 | 0.0258 | 0.0229 | 0.0193 | 0.0196 | 0.0206 |
| Sample 2 | 0.0258 | 0.0248 | 0.0205 | 0.0252 | 0.0259 |
| PAO 100 | 0.0258 | 0.0301 | 0.0235 | 0.0225 | 0.0216 |
| Traction coefficient, percent reduction compared to base stock | | | | | |
| Sample 1 | | 11 | 25 | 24 | 20 |
| Sample 2 | | 4 | 21 | 2 | 0 |
| PAO 100 | | −17 | 9 | 13 | 16 |

TABLE 2

MTM Traction coefficient data for a base stock comprising 80% YUBASE 4 and 20% Priolube 3970.

| | Additive treat rate (wt %) | | | | |
|---|---|---|---|---|---|
| | 0 | 2.5 | 5 | 7.5 | 10 |
| 40° C. 0.1M/S sliding speed | | | | | |
| Sample 1 | 0.0526 | 0.0451 | 0.0438 | 0.0426 | 0.0426 |
| Sample 2 | 0.0526 | 0.0448 | 0.0419 | 0.0416 | 0.0415 |
| PAO 100 | 0.0526 | 0.0489 | 0.0487 | 0.0463 | 0.0466 |
| Traction coefficient, percent reduction compared to base stock | | | | | |
| Sample 1 | | 14 | 17 | 19 | 19 |
| Sample 2 | | 15 | 20 | 21 | 21 |
| PAO 100 | | 7 | 7 | 12 | 11 |
| 40° C. 0.2M/S sliding speed | | | | | |
| Sample 1 | 0.0332 | 0.0292 | 0.0275 | 0.0262 | 0.0262 |
| Sample 2 | 0.0332 | 0.0285 | 0.0266 | 0.0264 | 0.0261 |
| PAO 100 | 0.0332 | 0.0308 | 0.0301 | 0.0295 | 0.0291 |

TABLE 2-continued

MTM Traction coefficient data for a base stock comprising 80% YUBASE 4 and 20% Priolube 3970.

| | Additive treat rate (wt %) | | | | |
|---|---|---|---|---|---|
| | 0 | 2.5 | 5 | 7.5 | 10 |
| Traction coefficient, percent reduction compared to base stock | | | | | |
| Sample 1 | | 12 | 17 | 21 | 21 |
| Sample 2 | | 14 | 20 | 20 | 21 |
| PAO 100 | | 7 | 9 | 11 | 12 |
| 60° C. 0.1M/S sliding speed | | | | | |
| Sample 1 | 0.0622 | 0.0445 | 0.0409 | 0.0378 | 0.0438 |
| Sample 2 | 0.0622 | 0.0389 | 0.0359 | 0.0361 | 0.0354 |
| PAO 100 | 0.0622 | 0.0508 | 0.0546 | 0.045 | 0.0438 |
| Traction coefficient, percent reduction compared to base stock | | | | | |
| Sample 1 | | 28 | 34 | 39 | 30 |
| Sample 2 | | 37 | 42 | 42 | 43 |
| PAO 100 | | 18 | 12 | 28 | 30 |
| 60° C. 0.2M/S sliding speed | | | | | |
| Sample 1 | 0.0443 | 0.0272 | 0.0231 | 0.0207 | 0.0258 |
| Sample 2 | 0.0443 | 0.0235 | 0.0208 | 0.0208 | 0.0202 |
| PAO 100 | 0.0443 | 0.0309 | 0.0327 | 0.0275 | 0.0244 |
| Traction coefficient, percent reduction compared to base stock | | | | | |
| Sample 1 | | 39 | 48 | 53 | 42 |
| Sample 2 | | 47 | 53 | 53 | 54 |
| PAO 100 | | 30 | 26 | 38 | 45 |

TABLE 3

MTM Traction coefficient data for a base stock of YUBASE 4.

| | Additive treat rate (wt %) | | | | |
|---|---|---|---|---|---|
| | 0 | 2.5 | 5 | 7.5 | 10 |
| 40° C. 0.1M/S sliding speed | | | | | |
| Sample 1 | 0.0509 | 0.0496 | 0.0461 | 0.0452 | 0.0489 |
| Sample 2 | 0.0509 | 0.0473 | 0.0452 | 0.0457 | 0.0471 |
| PAO 100 | 0.0509 | 0.0539 | 0.0518 | 0.0504 | 0.0489 |
| Traction coefficient, percent reduction compared to base stock | | | | | |
| Sample 1 | | 3 | 9 | 11 | 4 |
| Sample 2 | | 7 | 11 | 10 | 7 |
| PAO 100 | | −6 | −2 | 1 | 4 |
| 40° C. 0.2M/S sliding speed | | | | | |
| Sample 1 | 0.0348 | 0.0334 | 0.0315 | 0.031 | 0.0311 |
| Sample 2 | 0.0348 | 0.0325 | 0.0313 | 0.0315 | 0.0302 |
| PAO 100 | 0.0348 | 0.0359 | 0.0352 | 0.0342 | 0.0334 |
| Traction coefficient, percent reduction compared to base stock | | | | | |
| Sample 1 | | 4 | 9 | 11 | 11 |
| Sample 2 | | 7 | 10 | 9 | 13 |
| PAO 100 | | −3 | −1 | 2 | 4 |
| 60° C. 0.1M/S sliding speed | | | | | |
| Sample 1 | 0.0454 | 0.0446 | 0.0384 | 0.0394 | 0.0449 |
| Sample 2 | 0.0454 | 0.0426 | 0.0383 | 0.0415 | 0.0408 |
| PAO 100 | 0.0454 | 0.0528 | 0.0505 | 0.0493 | 0.0451 |
| Traction coefficient, percent reduction compared to base stock | | | | | |
| Sample 1 | | 2 | 15 | 13 | 1 |
| Sample 2 | | 6 | 16 | 9 | 10 |
| PAO 100 | | −16 | −11 | −9 | 1 |

TABLE 3-continued

| MTM Traction coefficient data for a base stock of YUBASE 4. | | | | | |
|---|---|---|---|---|---|
| | Additive treat rate (wt %) | | | | |
| | 0 | 2.5 | 5 | 7.5 | 10 |
| 60° C. 0.2M/S sliding speed | | | | | |
| Sample 1 | 0.0298 | 0.0293 | 0.0242 | 0.0242 | 0.0266 |
| Sample 2 | 0.0298 | 0.0279 | 0.0239 | 0.0263 | 0.0259 |
| PAO 100 | 0.0298 | 0.0333 | 0.0309 | 0.0304 | 0.0272 |
| Traction coefficient, percent reduction compared to base stock | | | | | |
| Sample 1 | | 2 | 19 | 19 | 11 |
| Sample 2 | | 6 | 20 | 12 | 13 |
| PAO 100 | | −12 | −4 | −2 | 9 |

TABLE 4

| MTM Traction coefficient data for a base stock of EHC 45. | | | | | |
|---|---|---|---|---|---|
| | Additive treat rate (wt %) | | | | |
| | 0 | 2.5 | 5 | 7.5 | 10 |
| 40° C. 0.1M/S sliding speed | | | | | |
| Sample 1 | 0.0587 | 0.0542 | 0.0537 | 0.0513 | 0.0507 |
| Sample 2 | 0.0587 | 0.0527 | 0.0513 | 0.0534 | 0.0522 |
| PAO 100 | 0.0587 | 0.0585 | 0.0567 | 0.0575 | 0.056 |
| Traction coefficient, percent reduction compared to base stock | | | | | |
| Sample 1 | | 8 | 9 | 13 | 14 |
| Sample 2 | | 10 | 13 | 9 | 11 |
| PAO 100 | | 0 | 3 | 2 | 5 |
| 40° C. 0.2M/S sliding speed | | | | | |
| Sample 1 | 0.0432 | 0.0404 | 0.0395 | 0.038 | 0.0372 |
| Sample 2 | 0.0432 | 0.0399 | 0.0388 | 0.0389 | 0.037 |
| PAO 100 | 0.0432 | 0.0426 | 0.0419 | 0.0421 | 0.0412 |
| Traction coefficient, percent reduction compared to base stock | | | | | |
| Sample 1 | | 6 | 9 | 12 | 14 |
| Sample 2 | | 8 | 10 | 10 | 14 |
| PAO 100 | | 1 | 3 | 3 | 5 |
| 60° C. 0.1M/S sliding speed | | | | | |
| Sample 1 | 0.0545 | 0.0461 | 0.0469 | 0.0439 | 0.043 |
| Sample 2 | 0.0545 | 0.0435 | 0.0432 | 0.0464 | 0.0529 |
| PAO 100 | 0.0545 | 0.054 | 0.0533 | 0.0553 | 0.051 |
| Traction coefficient, percent reduction compared to base stock | | | | | |
| Sample 1 | | 15 | 14 | 19 | 21 |
| Sample 2 | | 20 | 21 | 15 | 3 |
| PAO 100 | | 1 | 2 | −1 | 6 |
| 60° C. 0.2M/S sliding speed | | | | | |
| Sample 1 | 0.0365 | 0.0309 | 0.031 | 0.0287 | 0.0279 |
| Sample 2 | 0.0365 | 0.0301 | 0.0295 | 0.0313 | 0.0389 |
| PAO 100 | 0.0365 | 0.0359 | 0.0348 | 0.0353 | 0.0338 |
| Traction coefficient, percent reduction compared to base stock | | | | | |
| Sample 1 | | 15 | 15 | 21 | 24 |
| Sample 2 | | 18 | 19 | 14 | −7 |
| PAO 100 | | 2 | 5 | 3 | 7 |

Referring now to Table 5, below, the traction data for Perfad 3050, a commercially available polymeric friction modifier, clearly shows that it is not effective in reducing coefficient of traction at 40° C. In less severe, more hydrodynamic lubrication type test conditions contact the inclusion of Perfad 3050 leads to undesirable increased traction coefficients. For more severe test conditions at 60° C., and slower speed, Perfad 3050 does show some traction reduction effect akin to that of PAO 100, but this is inferior to the reduction in traction coefficient improvement observed for samples according to the present invention.

TABLE 5

| MTM Traction coefficient data for a base stock comprising 80% PAO4 and 20% Priolube 3970. | | | | | |
|---|---|---|---|---|---|
| | Additive treat rate (wt %) | | | | |
| | 0 | 2.5 | 5 | 7.5 | 10 |
| 40° C. 0.1M/S sliding speed | | | | | |
| Perfad 3050 | 0.042 | 0.0419 | 0.0418 | 0.0442 | 0.0419 |
| Sample 1 | 0.042 | 0.0403 | 0.0348 | 0.0375 | 0.0358 |
| PAO 100 | 0.042 | 0.0428 | 0.0399 | 0.0406 | 0.0388 |
| Traction coefficient, percent reduction compared to base stock | | | | | |
| Perfad 3050 | | 0 | 0 | −5 | 0 |
| Sample 1 | | 4 | 17 | 11 | 15 |
| PAO 100 | | −2 | 5 | 3 | 8 |
| 40° C. 0.2M/S sliding speed | | | | | |
| Perfad 3050 | 0.0249 | 0.0254 | 0.0253 | 0.0268 | 0.026 |
| Sample 1 | 0.0249 | 0.0243 | 0.0225 | 0.0218 | 0.0227 |
| PAO 100 | 0.0249 | 0.0242 | 0.024 | 0.0242 | 0.0241 |
| Traction coefficient, percent reduction compared to base stock | | | | | |
| Perfad 3050 | | −2 | −2 | −8 | −4 |
| Sample 1 | | 2 | 10 | 12 | 9 |
| PAO 100 | | 3 | 4 | 3 | 3 |
| 60° C. 0.1M/S sliding speed | | | | | |
| Perfad 3050 | 0.0465 | 0.0391 | 0.0414 | 0.0404 | 0.0382 |
| Sample 1 | 0.0465 | 0.0421 | 0.0366 | 0.0397 | 0.0345 |
| PAO 100 | 0.0465 | 0.052 | 0.0443 | 0.0398 | 0.0404 |
| Traction coefficient, percent reduction compared to base stock | | | | | |
| Perfad 3050 | | 16 | 11 | 13 | 18 |
| Sample 1 | | 9 | 21 | 15 | 26 |
| PAO 100 | | −12 | 5 | 14 | 13 |
| 60° C. 0.2M/S sliding speed | | | | | |
| Perfad 3050 | 0.0258 | 0.0221 | 0.0226 | 0.0238 | 0.0214 |
| Sample 1 | 0.0258 | 0.0229 | 0.0193 | 0.0196 | 0.0206 |
| PAO 100 | 0.0258 | 0.0301 | 0.0235 | 0.0225 | 0.0216 |
| Traction coefficient, percent reduction compared to base stock | | | | | |
| Perfad 3050 | | 14 | 12 | 8 | 17 |
| Sample1 | | 11 | 25 | 24 | 20 |
| PAO 100 | | −17 | 9 | 13 | 16 |

The invention claimed is:

1. A lubricant composition, suitable for use in an electric vehicle, comprising at least 50 wt % of a base stock based on the total weight of the lubricant composition and at least 7 wt % of a traction coefficient additive compound, based on the total weight of the lubricant composition, wherein the traction coefficient additive is present in an amount effective to provide a reduced traction coefficient and wherein the traction coefficient additive is of the Formula (I):

$$R^1[(AO)_n—R^2]_m \quad (I)$$

wherein:

$R^1$ is the residue of a group having at least 2 active hydrogen atoms;

m is at least 2;

AO is an alkylene oxide residue;

each n is independently from 0 to 100; and each $R^2$ is independently H or $R^3$, where each $R^3$ is independently a residue of a polyhydroxyalkyl or polyhydroxyalkenyl carboxylic acid, a residue of a hydroxyalkyl or hydroxyalkenyl carboxylic acid and/or a residue of an oligomer of the hydroxyalkyl or hydroxyalkenyl carboxylic acid; and on average at least 0.5 of $R^2$ groups are $R^3$; and wherein the lubricant composition is in contact with the power train of the electric vehicle in a manner effective to reduce the traction coefficient in a gear box of the powertrain.

2. A lubricant composition in accordance with claim 1, wherein $R^1$ of the traction coefficient additive compound of the Formula (I) is the residue of a $C_3$ to $C_{30}$ substituted hydrocarbyl compound.

3. A lubricant composition in accordance with claim 2, wherein $R^1$ of the traction coefficient additive compound of the Formula (I) is the residue of, or a residue derived from, a sugar.

4. A lubricant composition in accordance with claim 3, wherein $R^1$ of the traction coefficient additive compound of the Formula (I) is the residue of, or a residue derived from glucose, fructose, or sorbitol.

5. A lubricant composition in accordance with claim 4, wherein m of the traction coefficient additive compound of the Formula (I) is at least 3.

6. A lubricant composition in accordance with claim 5, wherein m of the traction coefficient additive compound of the Formula (I) is in the range from 4 to 10.

7. A lubricant composition in accordance with claim 6, wherein the alkylene oxide groups AO of the traction coefficient additive compound of the Formula (I) are of the formula:

$$—(C_rH_{2r}O)—$$

where r is 2, 3 or 4.

8. A lubricant composition in accordance with claim 7, wherein n of the traction coefficient additive compound of the Formula (I) is in the range from 1 to 50.

9. A lubricant composition in accordance with claim 8, wherein each $R^3$ of the traction coefficient additive compound of the Formula (I) is a residue of a polyhydroxylalkyl or polyhydroxyalkenyl carboxylic acid of formula HO—X—COOH where X is a divalent saturated or unsaturated, preferably saturated, aliphatic radical containing at least 8 carbon atoms and no more than 20 carbon atoms.

10. A lubricant composition in accordance with claim 9, wherein each $R^3$ of the traction coefficient additive compound of the Formula (I) is (poly) 12-hydroxystearic acid.

11. A lubricant composition in accordance with claim 1, comprising up to 20 wt % of the traction coefficient additive, based on the total weight of the lubricant composition.

12. A lubricant composition in accordance with claim 1, wherein the lubricant composition is a gearbox oil, comprising 7 wt % to 20 wt % of the traction coefficient additive, based on the total weight of the gearbox oil.

13. A method of reducing traction coefficient in a gearbox of an electric vehicle which comprises using a lubricant composition of claim 1 in the gearbox.

14. The lubricant composition of claim 3, wherein the sugar is a monosaccharide.

* * * * *